US006082708A

United States Patent [19]

Mullican et al.

[11] Patent Number: 6,082,708

[45] Date of Patent: Jul. 4, 2000

[54] PNEUMATIC JACK

[75] Inventors: Vernon T. Mullican; Diana C. Mullican; Harry M. Solakian, all of Fresno, Calif.

[73] Assignee: MSMS Equities, L.L.C.

[21] Appl. No.: 09/143,293

[22] Filed: Aug. 28, 1998

Related U.S. Application Data

[60] Provisional application No. 60/059,606, Sep. 23, 1997.

[51] Int. Cl.[7] ..... B66F 3/24

[52] U.S. Cl. ..... 254/93 HP

[58] Field of Search ..... 254/93 R, 93 H, 254/93 HP; 92/34, 35, 42; 267/122, 64.27, 64.23, 64.19

[56] References Cited

U.S. PATENT DOCUMENTS

| | | | |
|---|---|---|---|
| 3,523,679 | 8/1970 | Clay | 254/93 HP |
| 3,695,582 | 10/1972 | Clay | 254/93 HP |
| 3,730,481 | 5/1973 | Ekonen . | |
| 3,743,248 | 7/1973 | Moor . | |
| 3,751,007 | 8/1973 | Hollerith . | |
| 3,993,286 | 11/1976 | Greene et al. . | |
| 4,021,018 | 5/1977 | Dasan . | |
| 4,913,402 | 4/1990 | McJunkin . | |

*Primary Examiner*—Robert C. Watson
*Attorney, Agent, or Firm*—Richard A. Ryan

[57] ABSTRACT

A relatively low profile pneumatic jack comprising a bellows made from a flexible member having at least one convolution for lifting heavy objects, such as vehicles. The bellows is located between a lift member that abuts the object to be lifted and a base member which abuts the surface from which the object is being lifted (i.e., the ground). A top plate and a bottom plate connect to the bellows and the lift and base members to form an air-tight chamber within the bellows. An inlet valve is connected to the chamber to allow the introduction of pressurized air in the chamber. A valve assembly having safety systems therein to prevent overfilling of the jack is disposed between the supply of pressurized air and the inlet valve. A safety system inside the chamber further prevents overfilling of the jack.

37 Claims, 7 Drawing Sheets

PNEUMATIC JACK

CROSS-REFERENCE TO RELATED APPLICATIONS

This application claims the benefit of U.S. Provisional Patent Application Ser. No. 60/059,606 filed Sep. 23, 1997.

BACKGROUND OF THE INVENTION

1. Field of the Invention

The field of the present invention relates generally to devices for use in lifting objects. In particular, the present invention relates to portable pneumatically-operated lifting devices. Even more specifically, the present invention relates to low profile portable pneumatic jacks that utilize one or more pressurizable bellows.

2. Background

The most commonly available jacking system currently used today are mechanical jacking devices that require the user to place the jack under the object to be lifted, such as one side or end of a motor vehicle, and mechanically operate the jack to extend the lifting axis and raise the object. Mechanical jacking devices have a number of commonly known disadvantages, including lack of stability and strength and the requirement of mechanical effort on part of the user. Another disadvantage of mechanical lifting devices is the amount of space required for the user to effectively utilize the mechanical jack. The space requirement limits the usefulness of these devices in situations where there is not much room for the user to operate the mechanical jack.

Pneumatic jacks overcome many of the limitations of mechanical jacking devices and are commonly used to lift various objects in many different situations. A number of such jacks are portable to allow use at locations other than at fixed facilities, such as repair workshops or garages. One common use for portable pneumatic jacks is to lift one side or end of a motor vehicle or trailer off the ground surface to enable a person to replace a damaged tire or get under the motor vehicle to perform other repair work. For such use, the unextended pneumatic jack must have a low profile to allow the user to easily place the jack under the disabled vehicle. Once placed under the portion of the vehicle the user desires to raise, air or hydraulic fluid is directed toward the jack to extend it and raise the vehicle. In general, pneumatic jacks are suitable for lifting relatively heavy objects without requiring an undue amount of space or effort on part of the jack user.

A number of low profile pneumatic jacks are known. The known pneumatic jacks generally utilize a telescopically extendable lifting axis that extends in response to the introduction of air or hydraulic fluid into the jack. These type of jacks have a number of disadvantages, including known problems with the telescopic member sticking or even jamming during lifting or lowering operations.

Pneumatic jacks that rely on a telescoping member to obtain the desired lift have an inherent limit on the maximum amount of lift that can be obtained. The maximum lift of these type of pneumatic jacks is limited by the design of the telescoping member. A pneumatic jack that relies on flexible bellows for lift, such as the present invention, is not so limited. Although this could have some benefits in certain situations, the ability of the jack to obtain very high lift can result in an overturned vehicle or other object that is being lifted. To prevent over-filling and the potential for such problems, pneumatic jacks often incorporate an automatic pressure release valve that vents pressurized air to the atmosphere. Unfortunately, persons have been known to attempt to overcome the JACK automatic pressure release valves (i.e., by blocking the release port or other means) in order to obtain lift that is outside the range in which the pneumatic jack is designed.

3. Related Art

A number of related art devices exist that identify themselves as pneumatic or air-controlled lift devices. Such devices include U.S. Pat. No. 3,730,481 to Ekonen, U.S. Pat. No. 3,743,248 to Moor, U.S. Pat. No. 3,751,007 to Hollerith, U.S. Pat. No. 3,993,286 to Greene, U.S. Pat. No. 4,021,018 to Dasan, and U.S. Pat. No. 4,913,402 to McJunkin. None of these related art devices solve the problems identified and solved by the present invention in the manner solved by the present invention. Each of the aforementioned patents present pneumatic jacks that utilize a telescoping member. Only the Moor patent discloses the use of a bellows in conjunction with a low profile, portable pneumatic jack. The rubber bellows in the Moore patent, shown as 28 in FIG. 1 therein, merely serves as a casing to enclose the telescoping member and protect it against soiling and damage.

SUMMARY OF THE INVENTION

The pneumatic jack of the present invention solves the problems identified above. That is to say, the present invention provides a low profile, portable pneumatic jack utilizing a flexible bellows that extends in response to the introduction of air from a source of compressed air outside the jack to raise an object off a surface. The object is lowered by releasing air from the bellows. The pneumatic jack of the present invention utilizes multiple safety systems to prevent over-extension of the bellows that could result in damage to the pneumatic jack or overturning of the object being lifted (i.e., a motor vehicle).

In the primary embodiment of the present invention, the pneumatic jack comprises a bellows made from a reinforced flexible member having at least one convolution (i.e., the part of the flexible member that forms an annular protrusion larger than the outside diameter of the ends of the bellows) therein. The bellows is located between a lift member that abuts the object to be lifted and a base member that abuts the surface from which the object is being lifted. The bellows is connected to the lift member and base member by a top plate and bottom plate, respectively, that sealably connect to the bellows through use of a connecting member at each plate. When configured, the bellows provides an air-tight chamber that expands or contracts with the introduction or release of pressurized air from within the chamber. A valve assembly controls the introduction and release of air from an outside pressure source, such as an air compressor or equivalent. A safety valve system prevents over-extension of the bellows.

The bellows can be made from any number of available rubber or polymer materials that can be reinforced with various fiber, steel or other strengthening materials that allows the flexible member to extend while maintaining peripheral strength in the bellows. Bellows suitable for use in the pneumatic jack of the present invention can include those commonly available as air springs. The ends of the bellows sealably attach to top and lower plates that form the pressurizable chamber.

The valve assembly comprises a fitting that provides communication between an external source of pressurized air and the chamber formed by the bellows. The fitting can connect to an air line that is suitable for transmitting pressurized air from the air source. A spring-controlled dual valve assembly is disposed between the source of air and the fitting to control the flow of air into the chamber and the release of air from the chamber. The dual valve assembly comprises a safety system to prevent over-pressurizing of the chamber by preventing the air pressure inside the chamber from exceeding a predetermined level.

Inside the chamber formed within the bellows, the pneumatic jack can comprise a safety system that prevents over-filling, and therefore over-extension, of the bellows. In the preferred embodiment, the safety system comprises a pop-type valve in the top plate or the bottom plate, or both. When the bellows extends to the design limit, based on the construction of the pneumatic jack itself and the need to prevent the motor vehicle or other object from overturning, the pop valve activates to release air from the pressurized chamber. In the preferred embodiment, the air exits the chamber through one or more passageways that allow air to be released peripherally between the lift member and the top plate and/or between the base member and the bottom plate. Air exiting in the manner described above provides relatively rapid release of air and prevents the user from blocking a single exit port in an attempt to obtain additional lift from the pneumatic jack.

Accordingly, the primary objective of the present invention is to provide a pneumatic jack that utilizes pressurized air to lift heavy loads having the features generally described above and more specifically described below in the detailed description.

It is also an important objective of the present invention to provide a portable pneumatic jack that has a low profile when not pressurized. It is also an important objective of the present invention to provide a pneumatic jack that is of durable, extremely sturdy construction having substantially high lift capacity.

It is also an important objective of the present invention to provide a pneumatic jack that utilizes a bellows made of a flexible member that forms a pressurizable chamber in conjunction with top and bottom plates.

Yet another important objective of the present invention is to provide a pneumatic jack that has one or more safety systems to prevent over-filling and over-extension of the pneumatic jack wherein at least one of those safety systems is not able to be by-passed by the user of the jack.

It is a further objective of the present invention to provide a pneumatic jack having a dual valve assembly that facilitates filling and release of air from a pressurizable chamber while preventing any over-filling or over-extension of the jack.

The above and other objectives of the present invention will be explained in greater detail by reference to the attached figures and the description of the preferred embodiment which follows. As set forth herein, the present invention resides in the novel features of form, construction, mode of operation and combination of parts presently described and understood by the claims.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, and particularly with reference to the embodiment of the present invention illustrated in FIGS. 1 through 4, the preferred embodiment of the present invention is set forth below. The pneumatic jack, designated generally as 10, is designed to lift objects off the surface upon which the jack 10 rests.

Figure 1:
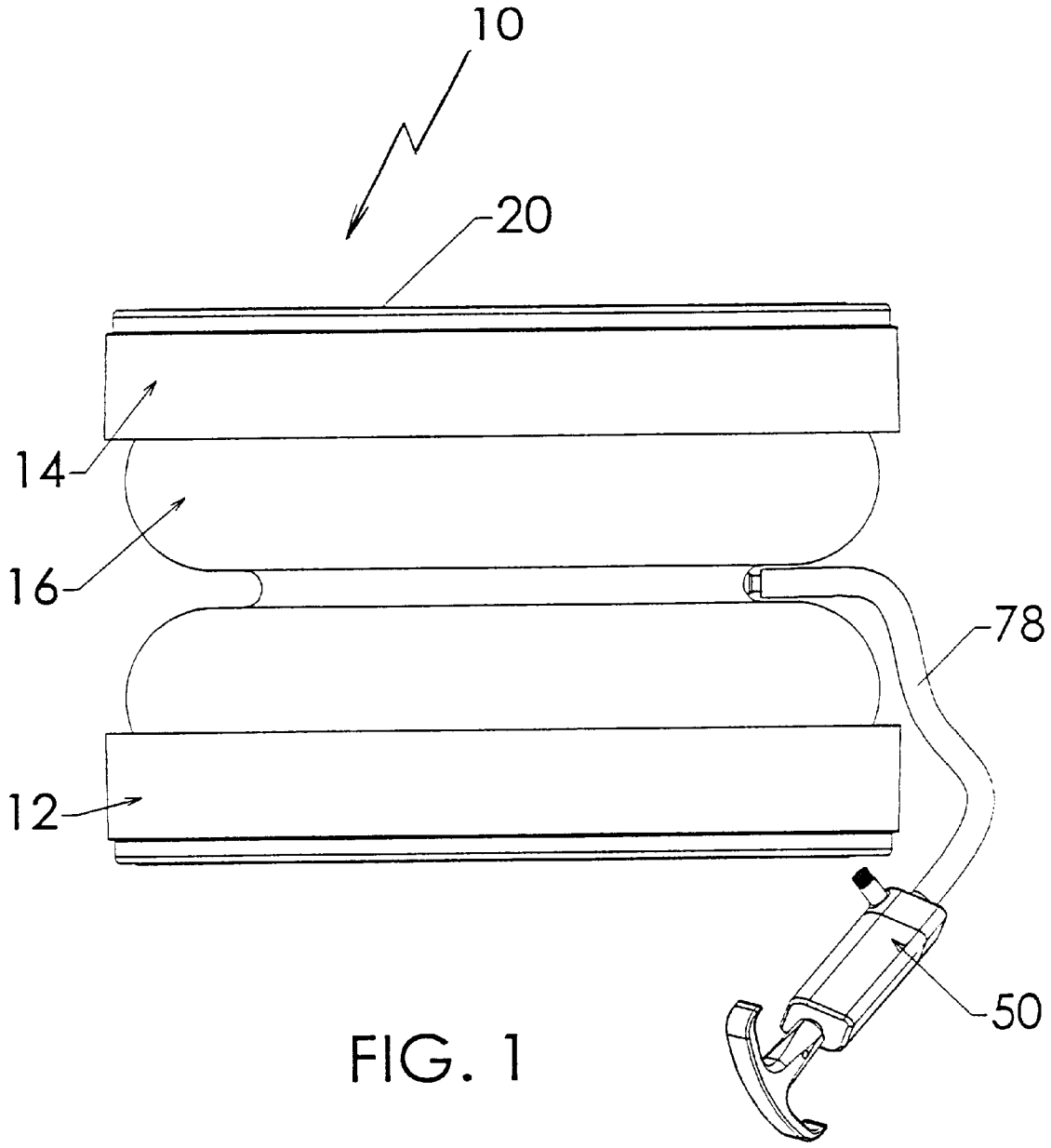
FIG. 1 is a side view of the preferred embodiment of the present invention.
Figure 2:
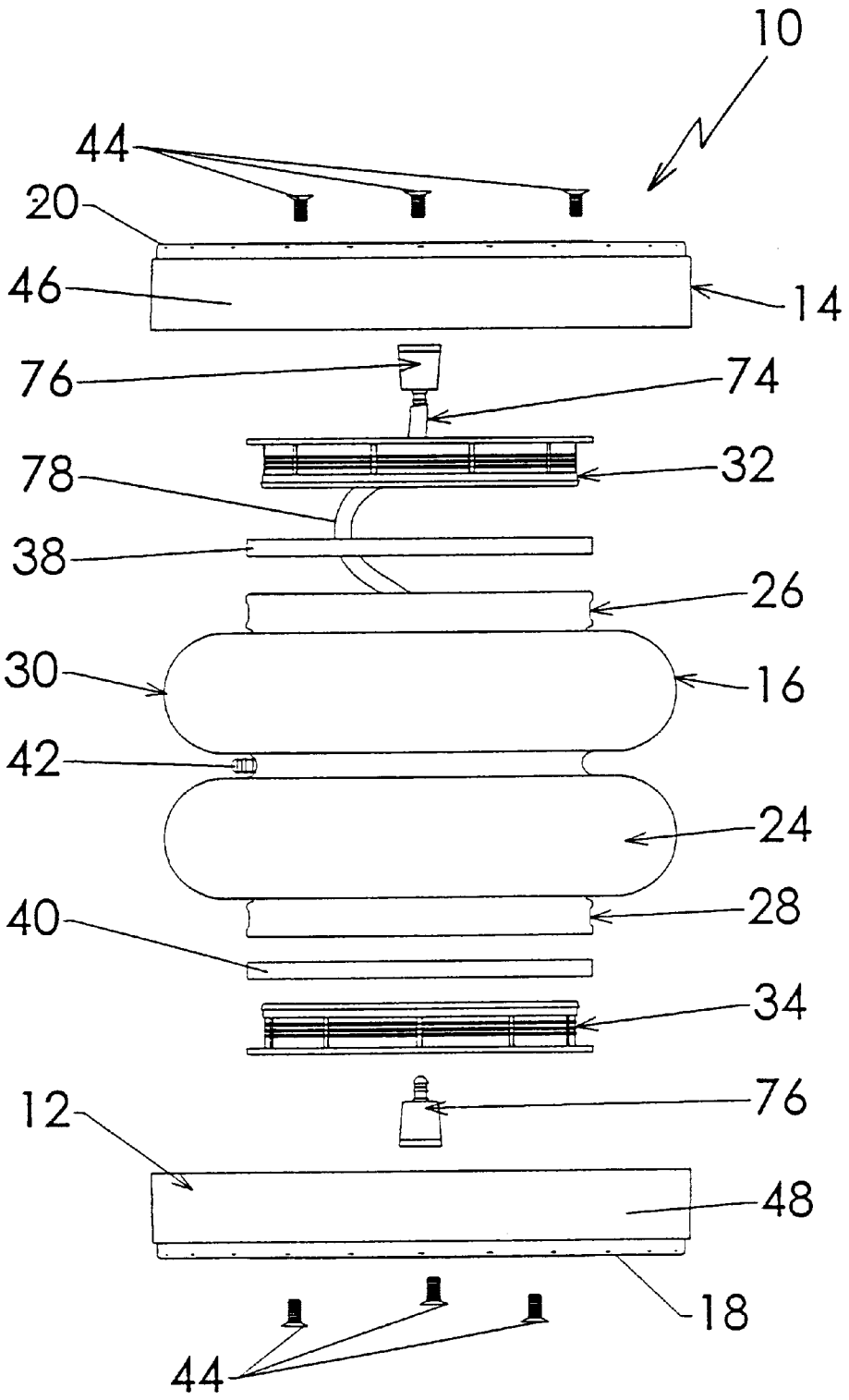
FIG. 2 is an exploded side view of the embodiment of the present invention shown in FIG. 1, excluding the valve mechanism.
Figure 3:
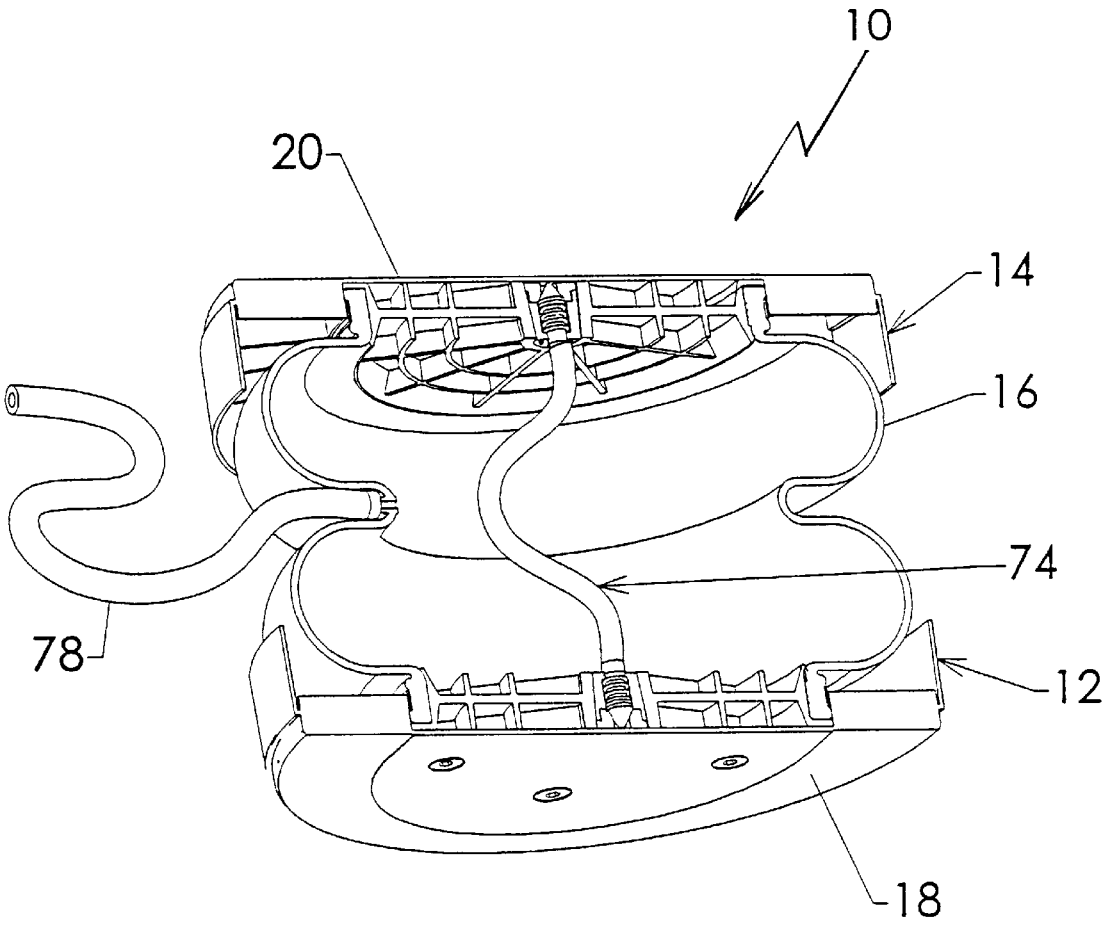
FIG. 3 is a cross-sectional perspective view of the present invention excluding the valve mechanism.
Figure 4:
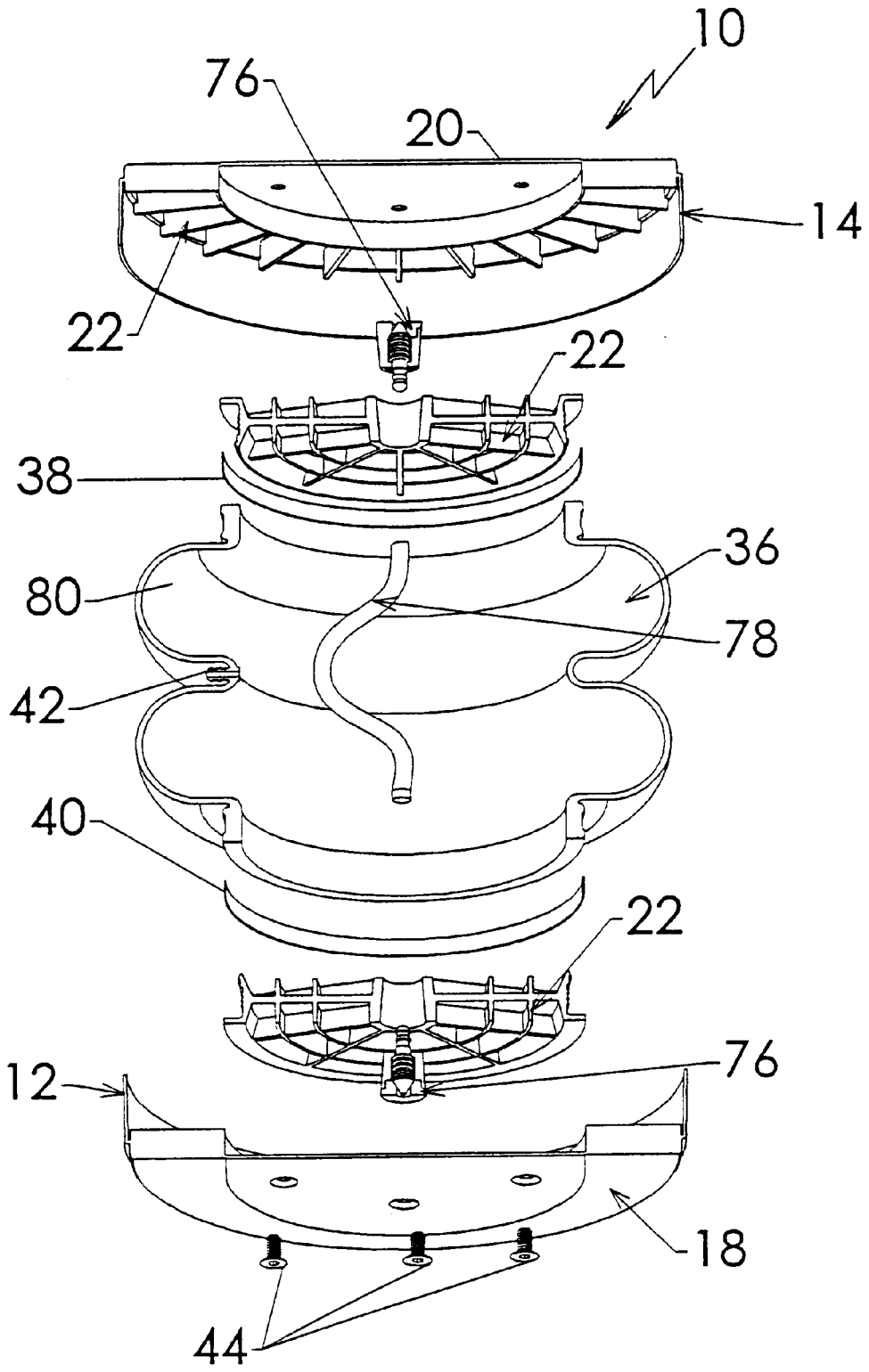
FIG. 4 is a exploded cross-sectional view of the present invention excluding the valve mechanism shown in FIG. 3.

Pneumatic jack 10 generally comprises base member 12 that is placed in contact with the surface from which the object is to be lifted, lift member 14 that can abut the object to be lifted, and bellows 16 that is disposed between base member 12 and lift member 14, as shown in FIG. 1. Base member 12 has a bottom surface 18 and lift member 14 has top surface 20, both of which can be generally planar in configuration, as shown in FIGS. 1 through 3. Although not illustrated in the accompany drawings, it is understood that bottom surface 18 and top surface 20 can be shaped and configured to conform to the surface from which the object is being lifted or the object to be lifted. For instance, top surface 20 can have one or more saddle-shaped indentations that traverse lift member 14 to enable it to better support the object to be lifted (i.e., such as an object having a frame).

In the preferred embodiment, base member 12 and lift member 14 are constructed of a plastic, metal or composite material, such as fiber or mineral reinforced plastics, that are of sufficient rigidity and strength to support the object to be lifted and confine the air pressure in bellows 16. Base member 12 and lift member 14 can be made to be nearly identical except for modifications to one or both to accommodate the filling and release of air from bellows 16 and the safety system discussed below. Either base member 12 or lift member 14, or both, can have a plurality of radially and/or circumferentially disposed support members 22 that provide structural support to base member 12 and/or lift member 14. Although shown in the accompany drawings as round in shape, both base member 12 and lift member 14 can be square, rectangular or any other shape that provides sufficient stability for lifting an object with jack 10. A round base member 12 and lift member 14, the preferred embodiment, has the advantage of generally being more stable when lifting loads and easier to make than other shapes.

Bellows 16 has a flexible member 24 that allows bellows 16 to extend to the desired height of lift for jack 10. Flexible member 24 has an upper end 26, lower end 28 and one or more convolutions 30 disposed between the upper end 26 and lower end 28. Flexible member 24 can be made of any of commonly available materials that are able to expand in the vertical direction, such as rubber, latex or polymers, such as neophrene and nitrile, yet be able to contain the pressurized air in a horizontal direction (when jack 10 is in an upright position). To provide the needed strength and support, the material for flexible member 24 can be reinforced with fiber, steel or other strengthening materials. An example of material that the inventors have found to be sufficient for the purposes described herein are found in air springs commercially available from Goodyear Tire & Rubber Company, Continental Tire Company and others. Generally, these air springs comprise bellows made of a thermoset or thermoplastic flexible material that has reinforcing materials imbedded or sandwiched between layers of rubber.

Sealably connected to upper end 26 of flexible member 24 is top plate 32 and sealably connected to lower end 28 is bottom plate 34. In the preferred embodiment, top plate 32 and bottom plate 34 are constructed of a polymer material, although aluminum or other metals can also be used. When both top plate 32 and bottom plate 34 are sealably connected to bellows 16, a pressurizable chamber 36 is formed within bellows 16. As best shown in FIG. 2, the preferred embodiment has a first connecting ring 38 to sealably connect upper end 26 to top plate 32 and a second connecting ring 40 to sealably connect lower end 28 to bottom plate 34 to form chamber 36. First 38 and second 40 connecting rings can be made of a polymer material, metal or other suitably rigid material that can hold both ends of flexible member 24 to the respective plates. Also in the preferred embodiment, bellows 16 has inlet port 42 for filling chamber 36 with pressurized air to vertically expand flexible member 24 and raise lift member 14. As shown in FIG. 1, inlet port 42 can be located in the center of bellows 16 between convolutions 30. In alternative embodiments of the present invention, inlet port 42 can be located on top plate 32 or bottom plate 34. Inlet port 42 should be suitable for connection to a supply of pressurized air (not shown).

Top plate 32 must be securely attached to the underside of lift member 14. Bottom plate 34 must be securely attached to the upperside of base member 12. Although the embodiment shown in FIGS. 1 through 3 utilizes bolts 44 to attach the plates to the respective base 12 or lift 14 members, machine screws, snaps, pins, glue or other types of attachment mechanisms can also be used. To better hold top plate 32 to lift member 14 and confine the upper end 26 of flexible member 24, lift member 14 can utilize lift side walls 46 along the periphery of lift member 14. In addition, if any support members 22 are used in lift member 14, they can be shaped and configured to provide further stabilization for top plate 32 and bellows 16. Base member 12 can utilize base side walls 48 along the periphery of base member 12 to better hold bottom plate 34 to base member 12 and confine lower end 28 of flexible member 24. Any support members 22 used in base member 12 can also be shaped and configured to provide further stabilization for bottom plate 34 and bellows 16.

Figure 5:
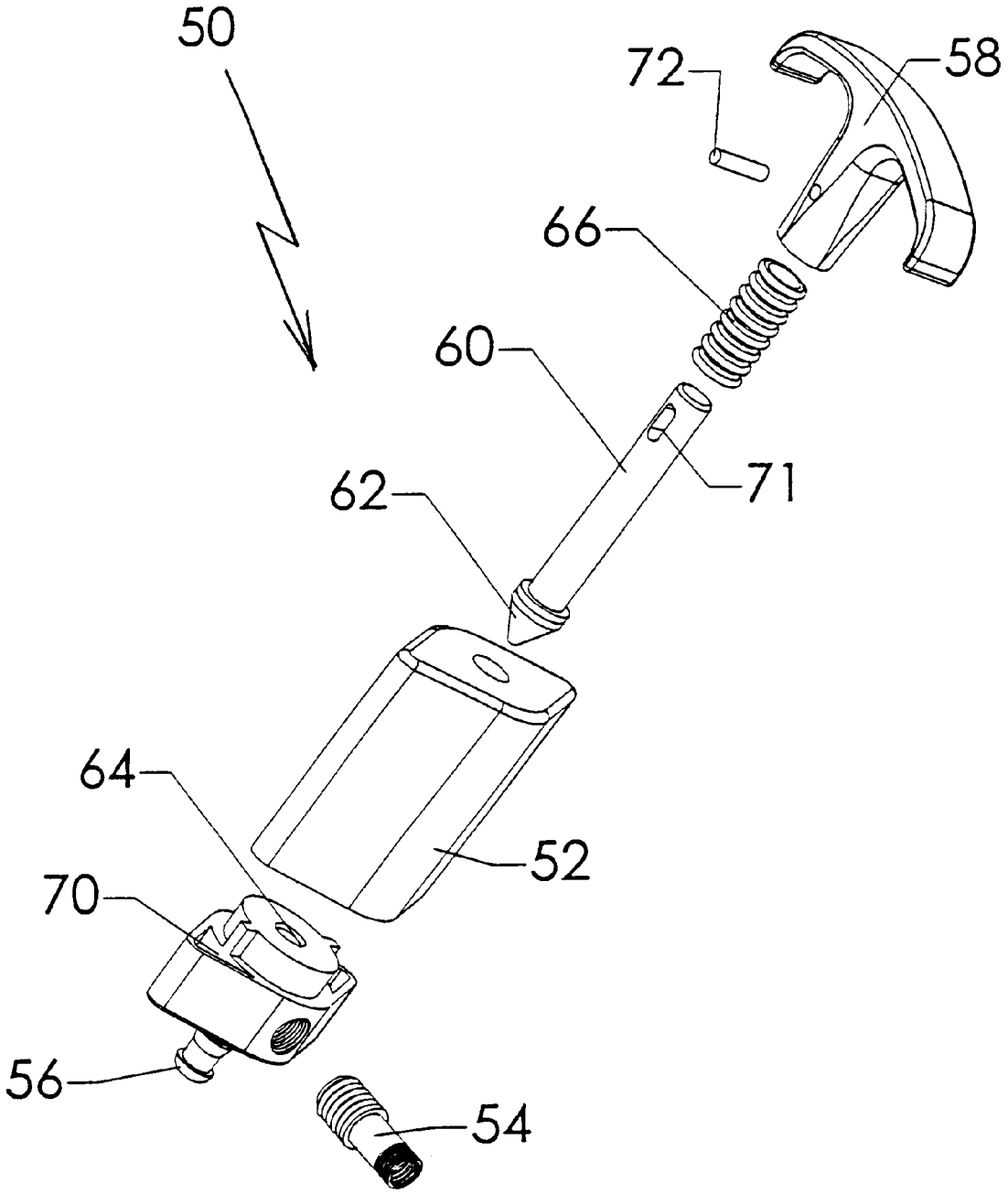
FIG. 5 is an exploded view of the valve mechanism of the preferred embodiment of the present invention.
Figure 6:
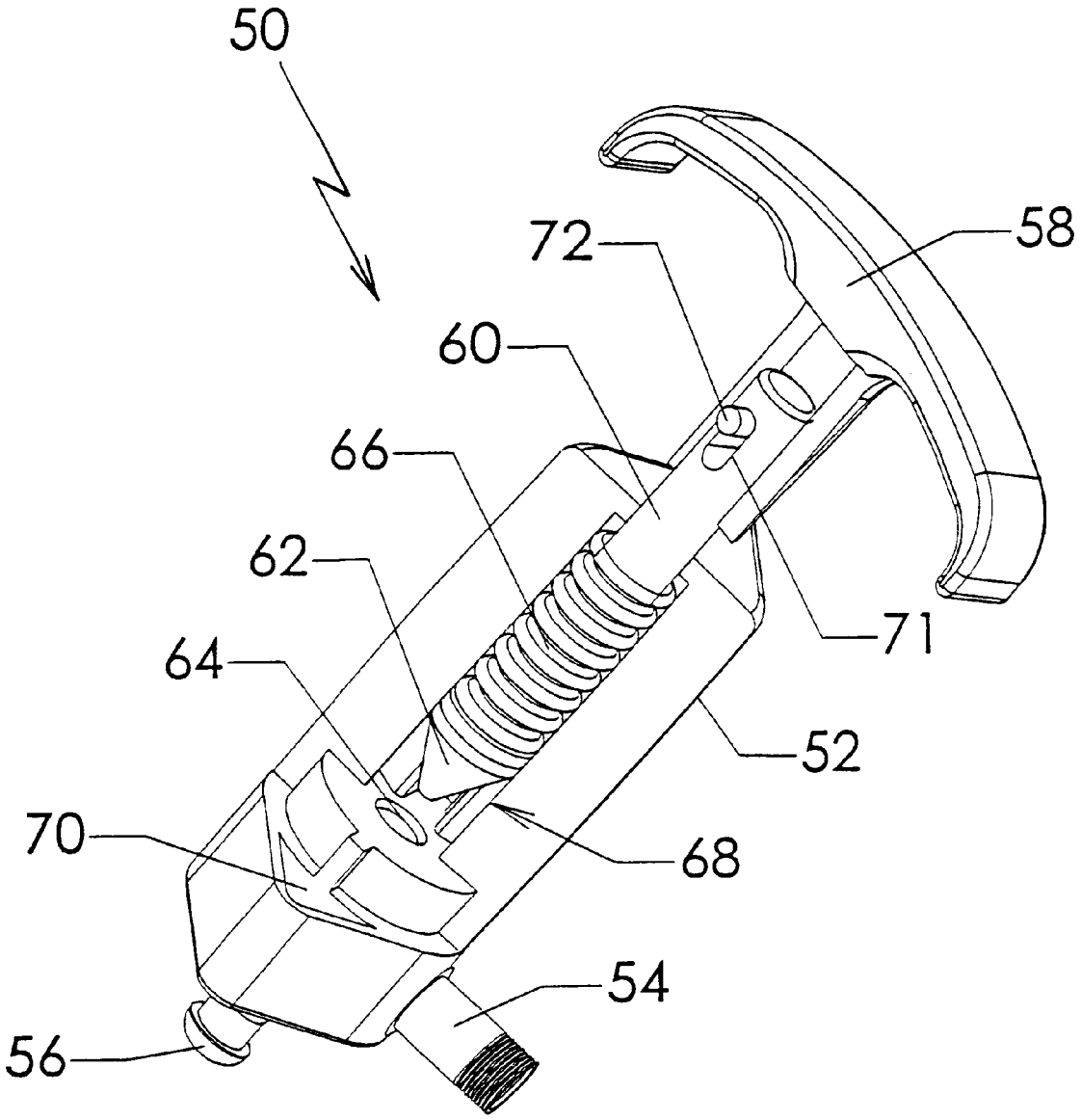
FIG. 6 is a cross-sectional view of the valve mechanism illustrated in FIG. 5.
Figure 7:
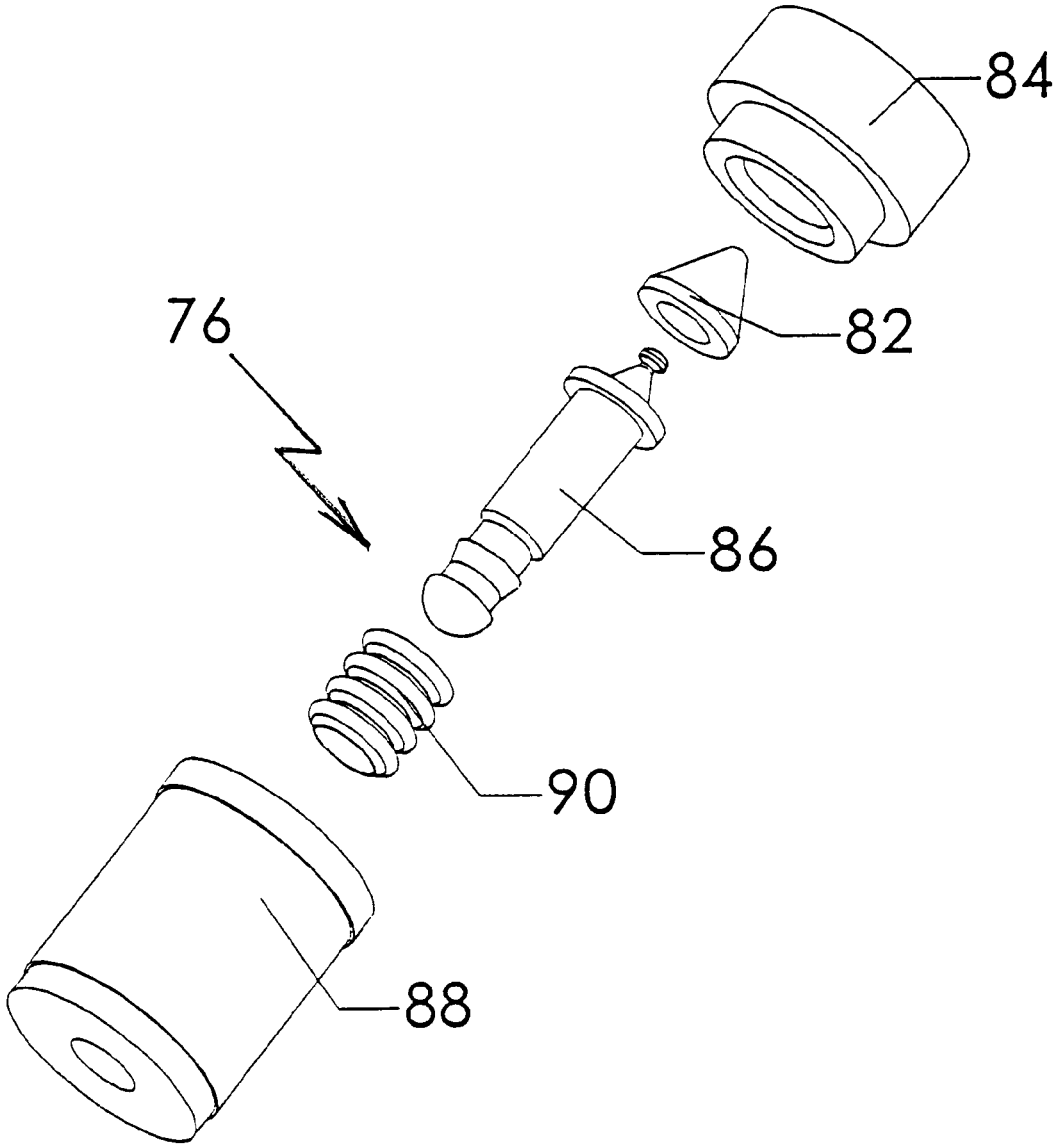
FIG. 7 is an exploded view of the vent valve of the preferred embodiment of the present invention.

A control valve 50 is located between the supply of pressurized air and inlet port 42 to control the admittance of pressurized air into chamber 36 to raise lift member 14 and the withdrawal of pressurized air from chamber 36 to lower lift member 14. In the preferred embodiment, shown in FIGS. 4 and 5, control valve 50 comprises a valve body 52 having a valve inlet 54 for connection to the supply of pressurized air and valve outlet 56 for flow to inlet port 42 and chamber 36. To prevent overfilling of bellows 16, the control valve 50 has valve handle 58 with a reduced diameter shaft 60 connected to valve tip 62 that is sized and configured to sit in valve seat 64. Control valve 50 should be designed and configured so that when the user desires to lift an object by filling chamber 36 with pressurized air, the user can connect the supply of pressurized air to valve inlet 54 and air will flow to chamber 36 through valve outlet 56 to raise lift member 14. In the preferred embodiment, as shown in FIG. 5, spring 66 in valve chamber 68 holds valve tip 62 in a closed position against valve seat 64. In normal operation, when the jack 10 has raised the vehicle a sufficient height, the user shuts off the air supply. Air pressure, and therefore jack 10 height, is maintained in the closed system. When the user is is ready to lower lift member 14, he or she pulls handle 58 out to unseat valve tip 62 from valve seat 64 to allow pressurized air to flow into valve passageways 70 and out jack 10.

To prevent overfilling or over-raising of jack 10 once the design limit pressure is reached, which is controlled by selecting the spring force, when the pressure inside chamber 36 exceeds the spring force it will unseat valve tip 62 from valve seat 64 to allow pressurized air to flow out valve passageways 68 in control valve 50, as described above. The pressure level at which the emergency release of pressurized air will occur (the inventors have found that 110 psi is generally sufficient for effective operation of jack 10) is such that the user will be unable to force handle 58 down to keep valve tip 62 on seat 64. Even if the user had sufficient strength or device to force handle 58 down to attempt to allow more air into chamber 36 than the jack 10 is designed to hold, the slot 71 and pin 72 connection would prevent any overfilling. As best shown in FIG. 5, when handle 58 is pushed down in an attempt to put more air in, the bottom of handle 58 will abut the top of valve body 52 before pin 72 abuts the top of slot 71. The continued upward movement of pin 72 in slot 71 will allow shaft 60 to continue moving upward such that valve tip 62 will unseat from valve seat 64 and allow air to flow out of past passageways 68, which should be designed and configured to make it difficult for the user to block or otherwise seal. The safety system for control valve 50 prevents the user from by-passing the safety protection to lift the jack 10 beyond its intended design limit.

Located inside chamber 36 is venting mechanism 74 to further prevent filling of jack 10 beyond its design limit. In the preferred embodiment, venting mechanism 74 has a vent valve 76 connected to and manually actuated by actuating member 78 that is connected at the opposite end to an inner wall 80 of chamber 36 (which is formed by bellows 16, top plate 32 and bottom plate 34). As shown in FIG. 2, vent valve 76 can be located at top plate 32 and actuating member 78 can connect to bottom plate 34. Vent valve 76 can be of the type that has a spring-loaded mechanism with a vent valve tip 82 that seats in vent valve seat 84. Vent valve tip 82 connects to vent shaft 86, which connects at the opposite end to vent valve body 88. Spring 90, over valve shaft 86 and inside valve body 88, should provide sufficient force to seat valve tip 82 in seat 84. Valve body 88 connects to actuating member 78.

To better obtain the action necessary to actuate vent valve 76, actuating member 78 can be elastic so that as it stretches to its elastic limit, it pops open vent valve 76 to unseat vent valve tip 82 from vent valve seat 84 and allow pressurized air to escape out of chamber 36, thereby preventing overfilling of chamber 36. One type of actuating member 78 is plastic tubing that interconnects vent valve 76, at bottom plate 34, and a second vent valve 76 at top plate 32. Although not shown, vent valve 76 can be located in the bottom plate 34, both top plate 32 and bottom plate 34, or in flexible member 24, alone or in combination with top 32 or bottom 34 plates.

An advantage of utilizing a vent valve 76 attached to top plate 32 or bottom plate 34 is that the released air from chamber 36 can exit out of the jack from between the top plate 32 and lift member 14 or from between bottom plate 34 and base member 12. If the annular space between the top plate 32 and lift member 14 or between the bottom plate 34 and base member 12 is configured such, the air can exit around the periphery of these components. This way, the user will be unable to block the exit path for the release of air from chamber 36 to overcome the safety feature and over-fill the jack 10, potentially damaging the jack or the object being lifted.

In operation, the user places the deflated jack 10 under an object to be lifted and connects a source of pressurized air to valve inlet 54. Spring 66 holds valve tip 62 against valve seat 64. The user then starts the flow of air from the supply of pressurized air. As pressurized air flows into chamber 36 through inlet port 42, lift member 14 raises to lift the object to the desired height, at which time the user terminates the flow of pressurized air into chamber 36. After the need for the object to be lifted is over (i.e., the tire is changed, etc.), the user pulls on handle 58 to allow the pressurized air to flow out of chamber 36 and past passageways 68 in control valve 50. If the user attempts to overfill the jack 10 with pressurized air by overcoming the safety mechanism in the control valve 50, the actuating member 78 will pull on vent valve 76 and unseat vent valve tip 82 from vent valve seat 84 to allow pressurized air to escape between the top plate 32 and lift member 14 and/or through other openings (not shown) connected to chamber 36.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use.

What is claimed is:

1. A pneumatic jack, comprising:

a base member having a bottom surface and a base side wall peripherally disposed about said base member;

a lift member having a top surface;

a bellows disposed between said base member and said lift member, said bellows comprising a flexible member having an upper end a lower end and one or more convolutions disposed between said upper end and said lower end;

a top plate sealably connected to said upper end of said bellows and connected to said lift member;

a bottom plate sealably connected to said lower end of said bellows and connected to said base member, said top plate, said bellows and said bottom plate forming a pressurizable chamber; and inlet means in communication with said chamber for admitting pressurized air into said chamber to raise said lift member relative to said base member and for withdrawing pressurized air from said chamber to lower said lift member, said inlet means suitable for connection to a source of pressurized air.

2. The pneumatic jack according to claim 1, wherein said base member further comprises a plurality of support members.

3. The pneumatic jack according to claim 1, wherein said lift member further comprises a lift side wall peripherally disposed about said lift member.

4. The pneumatic jack according to claim 1, wherein said lift member further comprises a plurality of support members.

5. The pneumatic jack according to claim 1 further comprising a first connecting means for sealably connecting said upper end of said bellows to said top plate.

6. The pneumatic jack according to claim 1 further comprising a second connecting means for sealably connecting said lower end of said bellows and said bottom plate.

7. The pneumatic jack according to claim 1 further comprising valve means disposed between said inlet means and said source of pressurized air for controlling the admittance of pressurized air into said chamber and the withdrawal of pressurized air from said chamber.

8. The pneumatic jack according to claim 7, wherein said valve means comprises pressure relief means for releasing air from said chamber when pressure in said chamber exceeds a predetermined amount.

9. The pneumatic jack according to claim 1 further comprising venting means in communication with said chamber for releasing air from said chamber whenever pressure therein exceeds a predetermined value.

10. The pneumatic jack according to claim 9, wherein said venting means comprises at least one vent valve and an actuating member interconnecting said vent valve and an inner wall of said chamber.

11. The pneumatic jack according to claim 10, wherein said vent valve is disposed in said top plate and pressurized air from said chamber is released peripherally between said top plate and said lift member to the atmosphere.

12. The pneumatic jack according to claim 10, wherein said vent valve is disposed in said bottom plate and pressurized air from said chamber is released peripherally between said bottom plate and said base member to the atmosphere.

13. A pneumatic jack, comprising:

a base member having a bottom surface and a plurality of support members;

a lift member having a top surface;

a bellows disposed between said base member and said lift member, said bellows comprising a flexible member having an upper end, a lower end and one or more convolutions disposed between said upper end and said lower end;

a top plate sealably connected to said upper end of said bellows and connected to said lift member;

a bottom plate sealably connected to said lower end of said bellows and connected to said base member, said top plate, said bellows and said bottom plate forming a pressurizable chamber; and inlet means in communication with said chamber for admitting pressurized air into said chamber to raise said lift member relative to said base member and for withdrawing pressurized air from said chamber to lower said lift member, said inlet means suitable for connection to a source of pressurized air.

14. The pneumatic jack according to claim 13, wherein said lift member further comprises a lift side wall peripherally disposed about said lift member.

15. The pneumatic jack according to claim 13, wherein said lift member further comprises a plurality of support members.

16. The pneumatic jack according to claim 13 further comprising valve means disposed between said inlet means and said source of pressurized air for controlling the admittance of pressurized air into said chamber and the withdrawal of pressurized air from said chamber.

17. The pneumatic jack according to claim 13 further comprising venting means in communication with said chamber for releasing air from said chamber whenever pressure therein exceeds a predetermined value, said venting means comprising at least one vent valve disposed in said top plate and an actuating member interconnecting said vent valve and an inner wall of said chamber, said vent valve configured to release pressurized air from said chamber to the atmosphere peripherally between said top plate and said lift member.

18. The pneumatic jack according to claim 13 further comprising venting means in communication with said chamber for releasing air from said chamber whenever pressure therein exceeds a predetermined value, said venting means comprises at least one vent valve disposed in said bottom plate and an actuating member interconnecting said vent valve and an inner wall of said chamber, said vent valve configured to release pressurized air from said chamber to the atmosphere peripherally between said bottom plate and said lift member.

19. A pneumatic jack, comprising:

a base member having a bottom surface;

a lift member having a top surface and a lift side wall, said lift side wall peripherally disposed about said lift member;

a bellows disposed between said base member and said lift member, said bellows comprising a flexible member having an upper end, a lower end and one or more convolutions disposed between said upper end and said lower end;

a top plate sealably connected to said upper end of said bellows and connected to said lift member;

a bottom plate sealably connected to said lower end of said bellows and connected to said base member, said top plate, said bellows and said bottom plate forming a pressurizable chamber; and inlet means in communication with said chamber for admitting pressurized air into said chamber to raise said lift member relative to said base member and for withdrawing pressurized air from said chamber to lower said lift member, said inlet means suitable for connection to a source of pressurized air.

20. The pneumatic jack according to claim 19, wherein said lift member further comprises a plurality of support members.

21. The pneumatic jack according to claim 19 further comprising valve means disposed between said inlet means and said source of pressurized air for controlling the admittance of pressurized air into said chamber and the withdrawal of pressurized air from said chamber.

22. The pneumatic jack according to claim 19 further comprising venting means in communication with said chamber for releasing air from said chamber whenever pressure therein exceeds a predetermined value, said venting means comprising at least one vent valve disposed in said top plate and an actuating member interconnecting said vent valve and an inner wall of said chamber, said vent valve configured to release pressurized air from said chamber to the atmosphere peripherally between said top plate and said lift member.

23. The pneumatic jack according to claim 19 further comprising venting means in communication with said chamber for releasing air from said chamber whenever pressure therein exceeds a predetermined value, said venting means comprises at least one vent valve disposed in said bottom plate and an actuating member interconnecting said vent valve and an inner wall of said chamber, said vent valve configured to release pressurized air from said chamber to the atmosphere peripherally between said bottom plate and said lift member.

24. A pneumatic jack, comprising:

a base member having a bottom surface;

a lift member having a top surface and a plurality of support members;

a bellows disposed between said base member and said lift member, said bellows comprising a flexible member having an upper end, a lower end and one or more convolutions disposed between said upper end and said lower end;

a top plate sealably connected to said upper end of said bellows and connected to said lift member;

a bottom plate sealably connected to said lower end of said bellows and connected to said base member, said top plate, said bellows and said bottom plate forming a pressurizable chamber; and inlet means in communication with said chamber for admitting pressurized air into said chamber to raise said lift member relative to said base member and for withdrawing pressurized air from said chamber to lower said lift member, said inlet means suitable for connection to a source of pressurized air.

25. The pneumatic jack according to claim 24 further comprising valve means disposed between said inlet means and said source of pressurized air for controlling the admittance of pressurized air into said chamber and the withdrawal of pressurized air from said chamber.

26. The pneumatic jack according to claim 24 further comprising venting means in communication with said chamber for releasing air from said chamber whenever pressure therein exceeds a predetermined value, said venting means comprising at least one vent valve disposed in said top plate and an actuating member interconnecting said vent valve and an inner wall of said chamber, said vent valve configured to release pressurized air from said chamber to the atmosphere peripherally between said top plate and said lift member.

27. The pneumatic jack according to claim 24 further comprising venting means in communication with said chamber for releasing air from said chamber whenever pressure therein exceeds a predetermined value, said venting means comprises at least one vent valve disposed in said bottom plate and an actuating member interconnecting said vent valve and an inner wall of said chamber, said vent valve configured to release pressurized air from said chamber to the atmosphere peripherally between said bottom plate and said lift member.

28. A pneumatic jack, comprising:

a base member having a bottom surface;

a lift member having a top surface;

a bellows disposed between said base member and said lift member, said bellows comprising a flexible member having an upper end, a lower end and one or more convolutions disposed between said upper end and said lower end;

a top plate sealably connected to said upper end of said bellows and connected to said lift member;

a bottom plate sealably connected to said lower end of said bellows and connected to said base member, said top plate, said bellows and said bottom plate forming a pressurizable chamber;

inlet means in communication with said chamber for admitting pressurized air into said chamber to raise said lift member relative to said base member and for withdrawing pressurized air from said chamber to lower said lift member, said inlet means suitable for connection to a source of pressurized air; and venting means in communication with said chamber for releasing air from said chamber whenever pressure therein exceeds a predetermined value, said venting means comprising at least one vent valve disposed in said top plate and an actuating member interconnecting said vent valve and an inner wall of said chamber, said vent valve configured to release pressurized air from said chamber to the atmosphere peripherally between said top plate and said lift member.

29. The pneumatic jack according to claim 28, wherein said base member further comprises a base side wall and a plurality of support members, said base side wall peripherally disposed about said base member.

30. The pneumatic jack according to claim 29, wherein said lift member further comprises a lift side wall peripherally disposed about said lift member.

31. The pneumatic jack according to claim 30, wherein said lift member further comprises a plurality of support members.

32. The pneumatic jack according to claim 28 further comprising valve means disposed between said inlet means and said source of pressurized air for controlling the admittance of pressurized air into said chamber and the withdrawal of pressurized air from said chamber.

33. A pneumatic jack, comprising:

a base member having a bottom surface;

a lift member having a top surface;

a bellows disposed between said base member and said lift member, said bellows comprising a flexible member having an upper end, a lower end and one or more convolutions disposed between said upper end and said lower end;

a top plate sealably connected to said upper end of said bellows and connected to said lift member;

a bottom plate sealably connected to said lower end of said bellows and connected to said base member, said top plate, said bellows and said bottom plate forming a pressurizable chamber;

inlet means in communication with said chamber for admitting pressurized air into said chamber to raise said lift member relative to said base member and for withdrawing pressurized air from said chamber to lower said lift member, said inlet means suitable for connection to a source of pressurized air; and venting means in communication with said chamber for releasing air from said chamber whenever pressure therein exceeds a predetermined value, said venting means comprises at least one vent valve disposed in said bottom plate and an actuating member interconnecting said vent valve and an inner wall of said chamber, said vent valve configured to release pressurized air from said chamber to the atmosphere peripherally between said bottom plate and said lift member.

34. The pneumatic jack according to claim 33, wherein said base member further comprises a base side wall and a plurality of support members, said base side wall peripherally disposed about said base member.

35. The pneumatic jack according to claim 34, wherein said lift member further comprises a lift side wall peripherally disposed about said lift member.

36. The pneumatic jack according to claim 35, wherein said lift member further comprises a plurality of support members.

37. The pneumatic jack according to claim 33 further comprising valve means disposed between said inlet means and said source of pressurized air for controlling the admittance of pressurized air into said chamber and the withdrawal of pressurized air from said chamber.

* * * * *